US010247183B2

(12) United States Patent
Koop et al.

(10) Patent No.: US 10,247,183 B2
(45) Date of Patent: Apr. 2, 2019

(54) HORIZONTAL PISTON COMPRESSOR

(71) Applicant: Howden Thomassen Compressors BV, Rheden (NL)

(72) Inventors: Laurentius Gerardus Maria Koop, Westervoort (NL); Petrus Nicolaas Duineveld, Angerlo (NL)

(73) Assignee: Howden Thomassen Compressors BV, AB Rheden (NL)

( * ) Notice: Subject to any disclaimer, the term of this patent is extended or adjusted under 35 U.S.C. 154(b) by 255 days.

(21) Appl. No.: 14/774,773

(22) PCT Filed: Mar. 13, 2013

(86) PCT No.: PCT/EP2013/055174
§ 371 (c)(1),
(2) Date: Sep. 11, 2015

(87) PCT Pub. No.: WO2014/139565
PCT Pub. Date: Sep. 18, 2014

(65) Prior Publication Data
US 2016/0032921 A1 Feb. 4, 2016

(51) Int. Cl.
*F04B 53/12* (2006.01)

(52) U.S. Cl.
CPC ..... *F04B 53/12* (2013.01)

(58) Field of Classification Search
CPC ..... F04B 53/12
See application file for complete search history.

(56) References Cited

U.S. PATENT DOCUMENTS 1,064,542 A 6/1913 Rittersback
2,299,033 A * 10/1942 Reed ..... F22D 5/08 122/456

(Continued)

FOREIGN PATENT DOCUMENTS

CH 359507 A 1/1962
CN 101305186 A 11/2008

(Continued)

OTHER PUBLICATIONS

Office Action of Japanese Patent Application No. 2015-561947 dated Jul. 26, 2016, 5 pages.

(Continued)

*Primary Examiner* — Peter J Bertheaud
*Assistant Examiner* — Dnyanesh Kasture
(74) *Attorney, Agent, or Firm* — Edell, Shapiro & Finnan, LLC

(57) ABSTRACT

A horizontal piston compressor is disclosed, including a frame with a cylinder, and a piston reciprocably received in the cylinder. The has piston h an inner chamber and first and second end walls. The piston and the cylinder form a compression chamber for compressing the gas. A valve and an orifice are disposed in the first end wall, and are configured to supply gas from the compression chamber to the inner chamber during a compression stroke of the piston. A gas bearing supports the piston relative to the frame. The gas bearing includes an opening for supplying gas from the inner chamber to a space between the piston and the cylinder such that the gas supplied to the space exerts an upward pressure on the piston. The valve may be a spring-loaded valve, and the orifice may be an orifice insert positioned between the valve and the compression chamber.

17 Claims, 5 Drawing Sheets

(56) References Cited

U.S. PATENT DOCUMENTS

| | | | | |
|---|---|---|---|---|
| 3,415,272 | A * | 12/1968 | Blackhawk | F16K 15/08 137/512.1 |
| 4,324,112 | A * | 4/1982 | Fujiwara | F25B 41/06 138/40 |
| 4,448,460 | A * | 5/1984 | Yamamoto | F16C 29/025 384/12 |
| 5,127,430 | A * | 7/1992 | Powers | F16K 27/0272 137/375 |
| 6,016,738 | A | 1/2000 | Elferink et al. | |
| 2007/0157801 | A1 | 7/2007 | Hanes | |
| 2013/0058815 | A1 | 3/2013 | Kim | |
| 2014/0255870 | A1 * | 9/2014 | Eakin | A61C 17/043 433/95 |

FOREIGN PATENT DOCUMENTS

| | | | |
|---|---|---|---|
| CN | 101815843 | A | 8/2010 |
| JP | 6188072 | U1 | 6/1986 |
| JP | 2003148652 | | 5/2003 |
| JP | 2008-121875 | A | 5/2008 |
| JP | 2012102779 | A | 5/2012 |
| WO | 96/15369 | A1 | 5/1996 |
| WO | 2009/026104 | A1 | 2/2009 |

OTHER PUBLICATIONS

Office Action of Japanese Patent Application No. 2015-561947 dated Feb. 7, 2017, 8 pages.

International Search Report and Written Opinion dated May 27, 2013 for PCT Application PCT/EP2013/055174 filed Mar. 13, 2013.

KIPO Notice of Final Rejection of Korean Patent Application No. 10-2015-7028935, dated Jun. 29, 107.

KIPO Notice of Final Rejection (Second Notice) of Korean Patent Application No. 10-2015-7028935, dated Oct. 20, 2017.

Office Action from Chinese Patent Office for Chinese Patent Application No. 201380074612.9 dated Aug. 17, 2016.

* cited by examiner

HORIZONTAL PISTON COMPRESSOR

BACKGROUND OF THE INVENTION

Field of the Invention

Embodiments of the invention generally relate to piston compressors for compressing gas, and more particularly to a horizontal piston compressor incorporating a free floating piston arrangement.

Discussion of Related Art

Horizontal piston compressors are generally known. Such piston compressors of are generally very large double-acting compressors with several cylinders and are used in the oil and petrochemicals industry. The forces of inertia which are the result of the large mass of the reciprocating parts of the compressor are a major reason for placing the cylinders horizontally in the frame. Although a large part of these forces can be compensated for by balancing the movements of the piston/piston rod units, the remaining forces on the frame of the compressor can be absorbed more readily by the bedplate of the compressor if they are directed horizontally instead of vertically.

Horizontal piston compressors suffer from a generally known problem with regard to supporting the reciprocating piston/piston rod unit relative to the stationary part of the compressor (i.e. the frame and the cylinder(s) forming part thereof). In general, a piston/piston rod unit is supported at the crosshead side by the crosshead which is guided in the frame, and at the other side the piston rests on the bottom part of the wall of the cylinder. The piston is often provided with one or more replaceable belts, which lie around the piston in the peripheral direction and project beyond the body of the piston. These belts are known as rider rings.

Over time, wear of the rider rings leads to run-out, which is permissible only within certain limits. Oil has generally been used as the lubrication between the piston and the cylinder wall in order to prevent excessive wear of the bearing surfaces and minimize the occurrence of run-out. The problem with oil lubrication, however, is that the lubricating oil can contaminate the compressed gas. As such, there is a continuing need for "oil free" compressors. To make an "oil free" compressor requires careful selection of the material of the rider rings and their fastening to the piston. In some cases the rider rings are made from materials with advantageous lubricating and wear properties, such as polytetrafluoroethylene (PTFE), commonly known as Teflon.

As previously noted, horizontal piston compressors are often used in situations where continuous operation is required. And although the mechanical construction of such compressors has developed so that the compressors can operate continuously at high efficiency for years, the wear rate of the rider rings is greater than desired. Thus, in practice the compressors have to be shut down after a few months in order to measure the wear on the rider rings and in order to be able to replace any rings which may be worn to unacceptable levels.

This maintenance adversely affects the overall efficiency and serviceability of this type of compressor. It would, therefore, be desirable to provide an improved bearing arrangement between the piston and the cylinder of the compressor which makes it possible to operate a compressor continuously for considerably longer periods than current compressors.

SUMMARY OF THE DISCLOSURE

A horizontal piston compressor is disclosed for compressing a gas. The compressor may include a frame having a cylinder oriented along a horizontal axis, and a piston reciprocably received in the cylinder. The piston may have an inner chamber and first and second end walls. The piston and the cylinder may form at least one compression chamber in which the gas is compressed. The compressor may further include a valve and orifice disposed in at least a portion of the first end wall of the piston. The valve and orifice may be configured to admit gas from the compression chamber to the inner chamber during a compression stroke of said piston. The compressor may also include a gas bearing for supporting the piston relative to the frame. The gas bearing may comprise an outflow opening for admitting gas from the inner chamber to a space between the piston and the cylinder. The position of the at least one outflow opening and the pressure of the gas may be such that the gas admitted to the space exerts an upward pressure on the piston rod unit.

In some embodiments, the valve comprises a spring-loaded valve, and the orifice comprises an orifice insert positioned between the valve and the compression chamber. In other non-limiting embodiments, the valve is a 1-inch nominal valve and the orifice insert can have an orifice diameter of from about 2 millimeters to about 5 millimeters, and a throat length of about 7 millimeters. It will be appreciated that these values are merely exemplary, and that other valve types, sizes, orifice diameters, and throat lengths can be used without departing from the scope of the disclosure.

In some non-limiting embodiments the outflow opening is configured to maintain a differential pressure ratio between the inner chamber and the space between the piston and the cylinder of about 0.6 to about 0.8. It will be appreciated that these values are merely exemplary, and that other values may be used. It will further be appreciated that the value of the differential pressure is determined by the mass of the piston/piston rod unit.

The at least one compression chamber may include first and second compression chambers, where the first compression chamber is formed by the cylinder and the first end wall of the piston, and the second compression chamber is formed by the cylinder and the second end wall of the piston. The first compression chamber may have first inlet and outlet valves and the second compression chamber may have second inlet and outlet valves.

When the gas pressure in the at least one compression chamber rises above a cracking pressure of the valve, gas in the at least one compression chamber may be admitted through the valve into the inner chamber of the piston.

In some embodiments the outflow opening includes a plurality of outflow openings. The compressor may further include first and second rider rings disposed about a periphery of the piston, where the first and second rider rings include the plurality of outflow openings. In other embodiments, the plurality of outflow openings are disposed in a bottom portion of the first and second rider rings.

The compressor may include a plurality of piston rings disposed about the periphery of the piston. At least one of the plurality of piston rings may be disposed between the first rider ring and the first end wall of the piston and at least another of the plurality of piston rings may be disposed between the second rider ring and the second end wall of the piston.

A piston is disclosed for use in a horizontal piston compressor. The piston may be configured to be reciprocably received in a cylinder of the compressor. The piston may include an inner chamber and first and second end walls, and may be configured to form at least one compression chamber with the cylinder in which a gas is compressed. The piston may include a valve and orifice disposed in at least a portion of the first end wall. The valve and orifice may be configured to admit gas from the compression chamber to the inner chamber during a compression stroke of the piston. The piston may form a gas bearing for supporting the piston relative to a frame of the compressor. The gas bearing may comprise an outflow opening for admitting gas from the inner chamber to a space between the piston and the cylinder. The position of the at least one outflow opening and the pressure of the gas may such that the gas admitted to the space exerts an upward pressure on the piston.

BRIEF DESCRIPTION OF THE DRAWINGS

The accompanying drawings illustrate preferred embodiments of the disclosed method so far devised for the practical application of the principles thereof, and in which.

DESCRIPTION OF EMBODIMENTS

Figure 1:
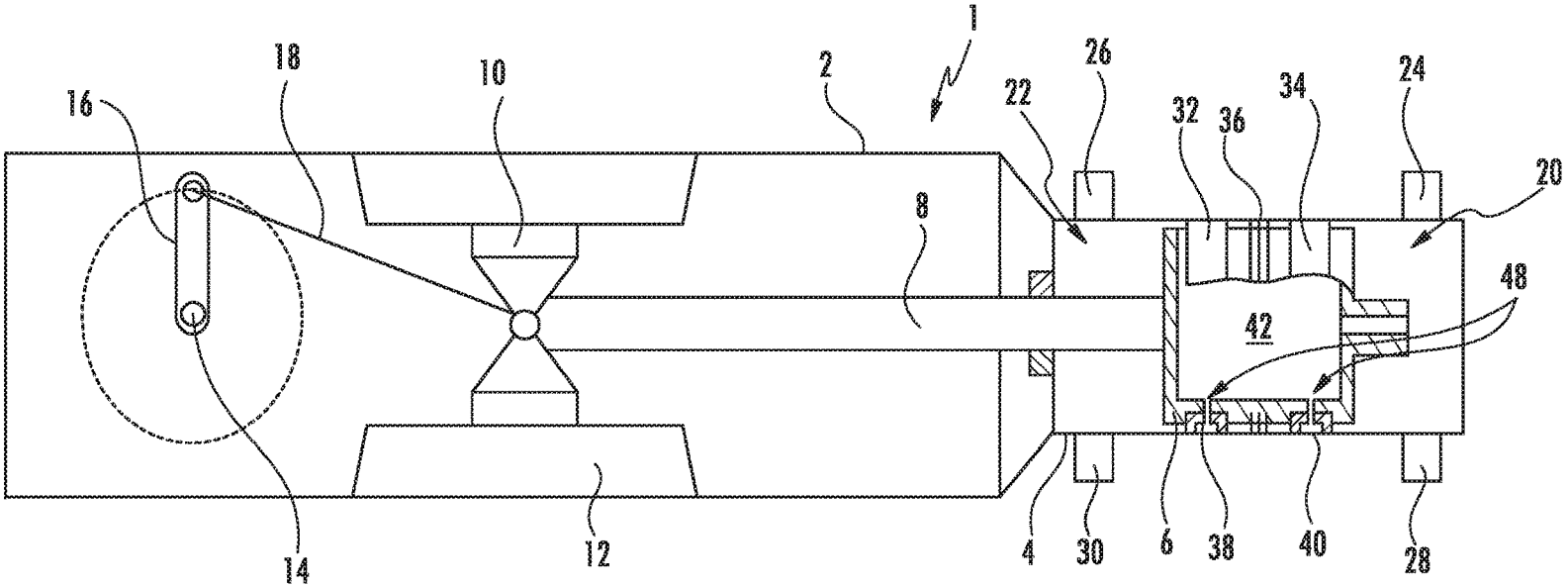
FIG. 1 is a cross-section view of an exemplary horizontal double acting piston compressor including the disclosed free floating piston.

An improved piston is disclosed for use in horizontal piston compressors. The improved piston is designed to float on a gas film created between the piston and the associated cylinder wall, thus reducing wear on the piston components in operation. By reducing wear, the disclosed design enables the associated compressor to operate for longer periods between component refurbishment as compared to prior designs. As will be described in greater detail later, the disclosed design also accommodates a wider range of differential operating pressures (suction vs. discharge), and smaller piston diameters, as compared to prior devices that employ such gas film technology, an example of which is disclosed in EP 0 839 280, the entirety of which is incorporated by reference herein.

Referring to FIGS. 1-4, an exemplary horizontal piston compressor 1 is shown. The compressor may include a frame 2, in which a cylinder 4 is slidably disposed. The cylinder 4 contains a piston 6, which reciprocable in the cylinder 4. The bottom part of the piston is shown in section, and the top part in elevation.

A piston rod 8 is fixed to the piston 6 at its right end, and at its left end is connected to crosshead 10. The crosshead 10 is guided reciprocably in a horizontal straight line in the frame 2 of the compressor by means of guides 12. The movement of the crosshead 10 is produced by a crank, such as is generally known in the case of horizontal piston compressors. The rotary movement of drive shaft 14 is transmitted to the crosshead 10 by way of the crank 16 to which it is connected and connecting rod 18, which is coupled between the crank 16 and the crosshead 10.

The compressor is of the double acting type, in which compression chambers 20 and 22 are formed in the cylinder 4 on either side of the piston 6. Each of the compression chambers 20, 22 is provided with an inlet valve 24, 26 and an outlet valve 28, 30, respectively. On movement of the piston 6 in the direction of the crank mechanism (i.e., to the left in FIG. 1), gas at a suction pressure is introduced by way of the inlet valve 24 into the compression chamber 20. At the same time the gas present in the compression chamber 22 is compressed and discharged at a discharge pressure by way of the outlet valve 30. Although not shown, a source of gas is coupled to the inlet valves 24, 26 of the compression chambers 20, 22, while the outlet valves 28, 30 will be coupled to appropriate discharge piping.

As can be seen, the frame 2 of the compressor is placed on a bedplate in such a way that the cylinder 4 is situated in a horizontal position. An arrangement is disclosed for the bearing support of the piston/piston rod unit, formed by the piston 6 and the piston rod 8. At the left end in FIG. 1 the unit rests via the crosshead 10 on the frame 2, lubricating oil generally being introduced between the guides 12 and the crosshead 10. However, this support at the crosshead 10 is unable to prevent the piston 6 from dragging along the bottom part of the wall of the cylinder 4, in particular because there will be a certain degree of play between crosshead 10 and guides 12, which permits tilting of the crosshead 10, and because the slim piston rod 8 will bend. The other bearing means which support the piston/piston rod unit are described below.

Figure 2:
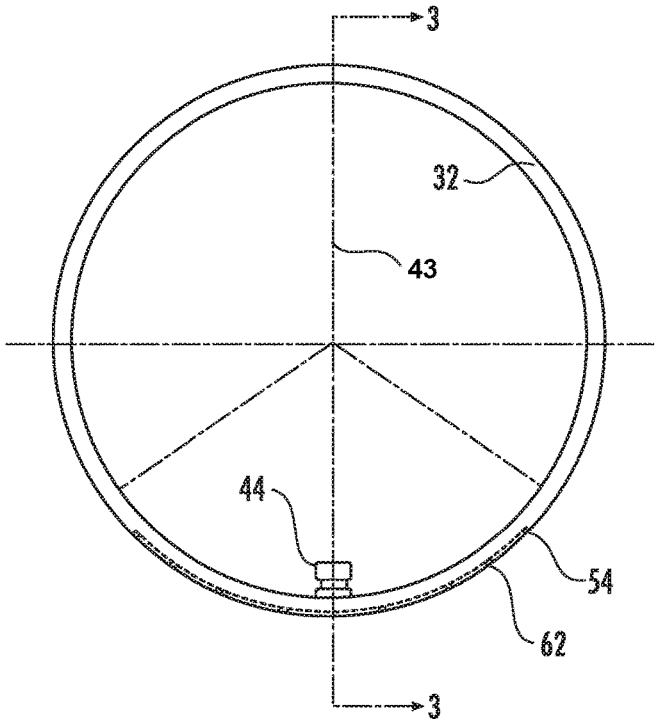
FIG. 2 is a side view of an exemplary rider ring for use in the compressor of FIG. 1.
Figure 3:
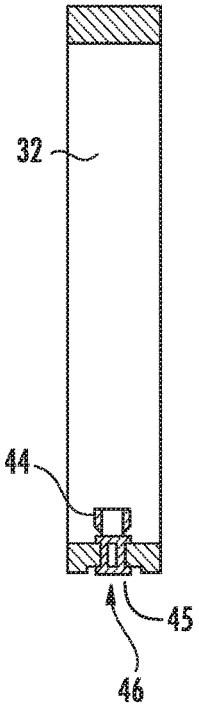
FIG. 3 is a cross-section view, taken along line 3-3 of FIG. 2, of the rider ring of FIG. 2.
Figure 4:
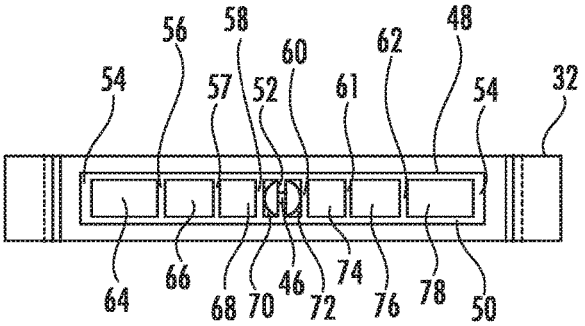
FIG. 4 is a bottom view of the rider ring of FIG. 2.

Around the piston 6, near each end face thereof, a rider ring, which will be explained in further detail with reference to FIGS. 2, 3 and 4, is fitted in a peripheral groove in the body of the piston 6. The rider rings 32 and 34 project over a short distance beyond the body of the piston 6. An assembly of piston rings 36 may also be provided around the body of the piston 6. In the illustrated embodiment the piston rings 36 are disposed between the rider rings 32, 34. It will be appreciated, however, that in other embodiments the piston rings 36 may be disposed between the rider rings 32, 34 and the ends of the piston 6. As will be appreciated, the piston rings 36 may act to prevent gas from flowing from the high-pressure side of the cylinder 4 to the low-pressure side.

As can be seen in FIG. 1, a chamber 42 of the piston 6 is in communication with one or more outflow openings 38, 40 formed in each rider ring. The source, which is formed by a chamber 42 combined with the part of the compressor which supplies gas under pressure to said chamber 42, should be designed in such a way that during the operation of the compressor gas under pressure constantly flows out of the chamber 42 to the outflow openings 38 and 40. As will be appreciated, the gas forms a gas film between the rider rings 32, 34 and the smooth wall of the cylinder 4. The bearing capacity of this gas film is determined by the pressure of the gas in the film and the surface over which the pressure acts upon the part of the piston/piston rod unit to be supported. This surface will be a section of the bottom half of the rider ring.

It will be appreciated that in some embodiments the rider rings may not be disposed in a groove in the body of the piston, but rather the body of the piston may be constructed of several separate segments, and a rider ring may be clamped between two segments.

An exemplary embodiment of the rider rings 32 and 34 will now be described in relation to rider ring 32 of FIGS. 2, 3 and 4. The rider ring 32 is an annular element with an accurate cylindrical inside diameter, which is adapted to the peripheral groove to be formed in the body of the piston, in which groove the ring is placed. However, the outer periphery of the rider ring 32 is not exactly cylindrical. As can be seen in FIG. 2, the bottom segment of the outer periphery when the rider ring is fitted has a slightly larger radius than the top segment connecting thereto. The bottom segment extends through an angle on either side of the vertical 43, and the radius virtually corresponds to the radius of the cylinder along which the rider ring moves. The reasons for this design of the outer periphery is that for forming the gas film between the rider ring 32 and the cylinder 4 it must be configured to move the piston 6 upwards a slight distance and sufficient play should remain for mechanical and thermal deformation.

It can be seen in FIG. 3 a nipple 44 engages the rider ring, with a bore which opens out in a circular end face 45. The end face 45 lies recessed relative to the outer periphery of the rider ring 32. For the setting of the gas film it may be important that the outflow opening 46 in the nipple 44 can restrict the gas flow. The outflow opening 46 is in communication with the chamber 42 by way of a bore 48 in the wall of the piston 6 (see FIG. 1).

As previously described, the supporting capacity of this gas bearing system is determined, inter alia, by the effective surface over which the gas film supports the piston/piston rod unit. In order to obtain a large surface with a stable gas film, a pattern of grooves is provided in the bottom segment of the rider ring 32, which can be seen in particular from FIG. 4. In one embodiment, the pattern of grooves comprises two parallel main grooves 48, 50, which lie on either side of the nipple 44. It can be seen from FIG. 2 that each of the main grooves 48, 50 extends through an angle symmetrically towards either side, along outflow opening 46 of the nipple 44 situated on the vertical 43. A central transverse groove 52 connects the two main grooves 48, 50 to the outflow opening 46. At their ends the main grooves 48, 50 are connected by transverse grooves 54. Transverse grooves 56-62, lying symmetrically relative to the vertical 43, connect the two main grooves 48, 50 and in this way form fields 64-78. The fields 64-78 lie flush with the remaining part of the bottom segment of the rider ring 32.

It will be appreciated that the illustrated pattern of grooves is only one possible solution, and thus is not limiting. It is contemplated that in certain applications the pattern of grooves may be eliminated, and instead one or more outflow openings in the form of a simple bore may be provided. The rider rings 32 and 34 may be made from a material which has advantageous emergency running properties, so that if the gas film accidentally falls off no undesirable wear of the cylinder wall will occur. A non-limiting example of a suitable material is PTFE.

As previously noted, the gas is not shown, and it will be appreciated that a variety of different supply arrangements are contemplated. In principle, the main condition which such a source must meet is that gas should flow constantly out of one or more of the outflow openings, in order to maintain a gas film between the cylinder and the piston. The outflow of the gas from an outflow opening will in this case depend, inter alia, on the pressure in the region to which the gas flows. In some embodiments it may be important that the source can supply gas at a pressure which is higher, or considerably lower, than the maximum delivery pressure of the gas in a compression chamber of the compressor. For example, it is possible for the source to be formed by a higher pressure stage of the same compressor or of another compressor.

Figure 5:
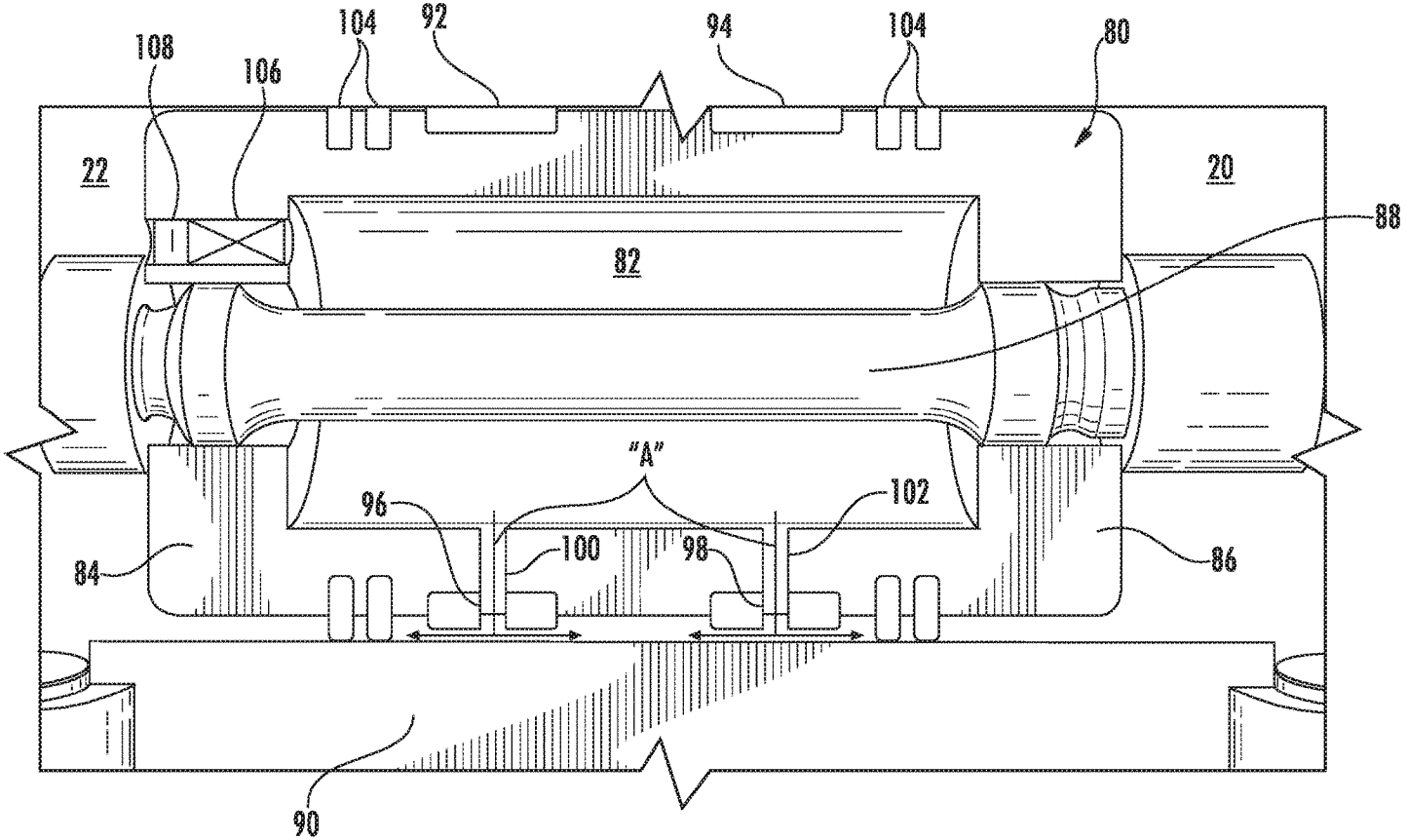
FIG. 5 is a cross section view of an exemplary embodiment of the disclosed free floating piston (FFP) arrangement.

Referring now to FIG. 5 an exemplary piston 80 for use with the disclosed compressor 1 will be described in greater detail. The piston 80 is a generally cylindrical member having an inner chamber 82 and first and second ends 84, 86. A piston rod 88 extends through openings in the first and second ends 84, 86 for moving the piston 80 in a reciprocal fashion within the cylinder 90. The piston 80 may include first and second rider rings 92, 94 disposed in circumferential grooves formed in the exterior surface of the piston. The first and second rider rings 92, 94 may have a construction substantially the same as the rider rings described in relation to FIGS. 2-4. Thus, a bottom portion of each ring may include an outflow opening 96, 98 in communication with a respective bore 100, 102 formed in the piston wall to enable gas in the inner chamber 82 to exit through the outflow openings and bores. The piston 80 may also include a plurality of piston rings 104 located between the rider rings 92, 94 and respective ends 84, 86 of the piston. The piston rings 104 may be disposed in circumferential grooves formed in the outer surface of the piston. The illustrated embodiment employs two pairs of piston rings 104 between each rider ring and the respective piston end. It will be appreciated that alternative arrangements can also be used.

A valve 106 may be disposed in the first end 84 (or alternatively, the second end 86) of the piston 80 to provide a flow path for gas to travel from the compression chamber 22 of the cylinder 4 (see FIG. 1) into the inner chamber 82 of the piston. As will be described in greater detail later, the valve 106 may include an orifice 108 positioned upstream of the valve. In one embodiment the valve 106 is a spring loaded valve, and the orifice 108 is provided integral to the valve 106. Thus arranged, gas may be admitted to the inner chamber 82 when a predetermined pressure is achieved in the compression chamber 22 of the cylinder. The gas may then pass out through the outflow openings 96, 98 in the rider rings 92, 94 along the direction of arrow "A" to provide the aforementioned gas layer between the outer surface of the piston 80 and the inner surface of the cylinder 4.

Figure 6:
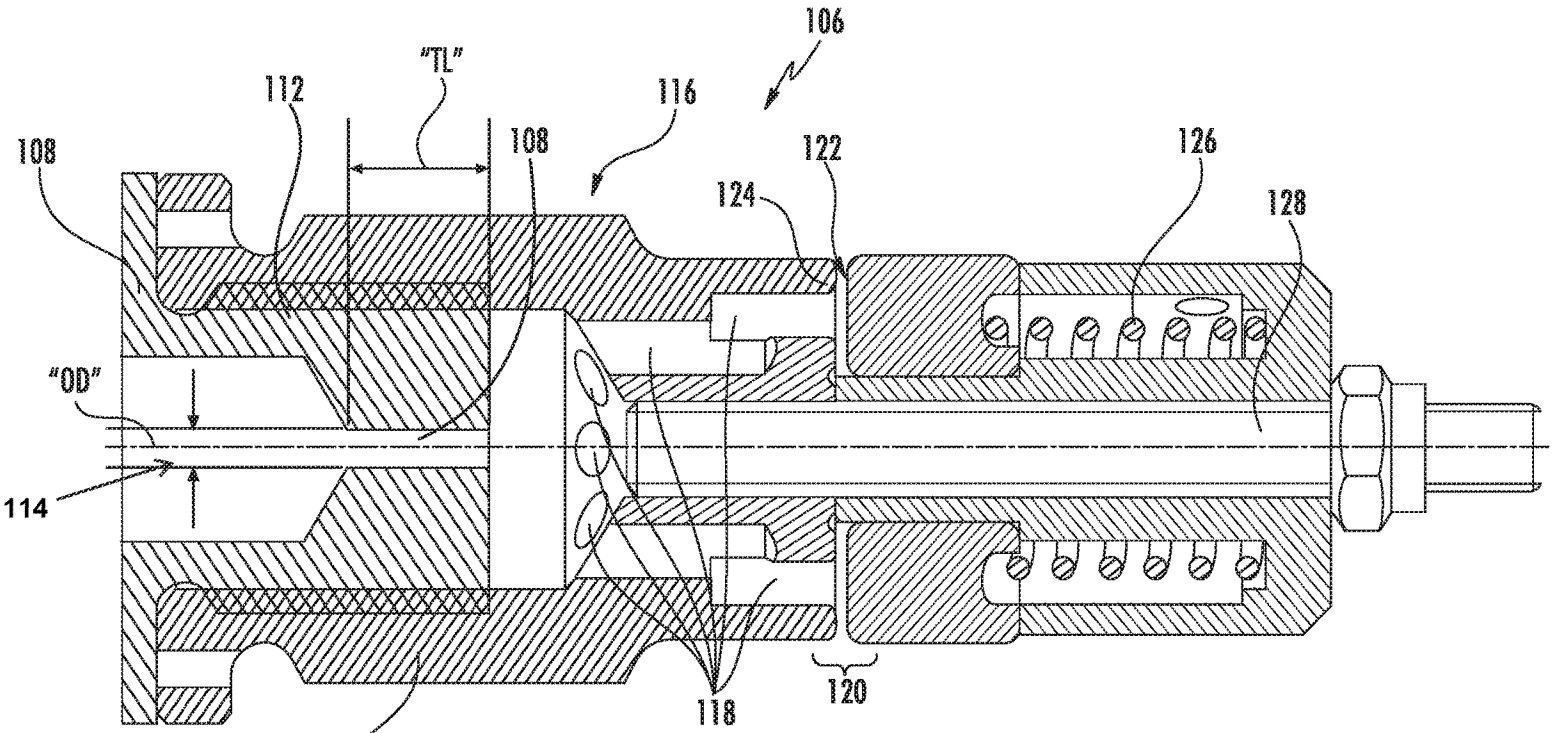
FIG. 6 is a cross section view of an exemplary FFP valve for use in the FFP arrangement of FIG. 5.

Referring to FIG. 6, a non-limiting exemplary embodiment of a valve 106 is shown for use with piston 80 of FIG. 5. The valve 106 may include an integral orifice portion 108, which in the illustrated embodiment consists of a threaded insert received in an inlet portion 110 of the valve. It will be appreciated that although a threaded orifice insert is shown, such an arrangement is not limiting, and other orifice arrangements are also contemplated. In the illustrated embodiment, the orifice portion 108 may have a threaded body 112 and an orifice 114. The orifice 114 may have an orifice diameter "OD" and a throat length "TL." In one non-limiting exemplary embodiment, the orifice diameter "OD" may be from about 2 millimeters (mm) to about 5 mm, and the throat length may be a minimum of about 7 mm. It will be appreciated, however, that other valves, and other orifices having other orifice dimensions and throat lengths can also be used. The valve 106 may include a body portion 116 having a plurality of flow paths 118 through which gas can pass from the orifice portion 108 to the seat area 120. A valve stem portion 122 may include a facing surface 122 that is spring biased into contact with a valve seat portion 124 of the valve body via a spring 126 mounted about valve stem 128. Thus arranged, the interaction between the facing surface 122 and the valve seat portion 124 blocks the flow of gas from the flow paths 118 when the gas pressure in the valve is lower than a predetermined cracking pressure. When gas pressure in the valve exceeds the predetermined cracking pressure, the spring 126 compresses and the facing surface 122 moves away from the valve seat portion, allowing gas to flow through the valve and into the inner chamber 82 of the piston (see FIG. 5). FIG. 6 illustrates the valve 106 in the open configuration in which gas can pass from the compression chamber 22 to the inner chamber 82 of the piston (FIG. 5). When gas pressure in the valve reduces to a value below the predetermined cracking pressure, the force of the spring 126 then moves the facing surface 122 into engagement with the valve seat portion 124, preventing the flow of gas from between the body and seat.

It will be appreciated that the orifice 108 can be separately mounted in the piston body, and thus it need not be integral to the valve 106. The orifice diameter is designed to limit the flow rate to approximately 1% of the delivery flow of the specific piston. The cracking pressure is determined by the spring load on plate face 122, and is the main parameter for the stability (gradually opening and closing) of face 122. In some embodiments the cracking pressure can be less than 0.5% of the pressure in chambers 20 and/or 22 (FIG. 5).

Figure 7:
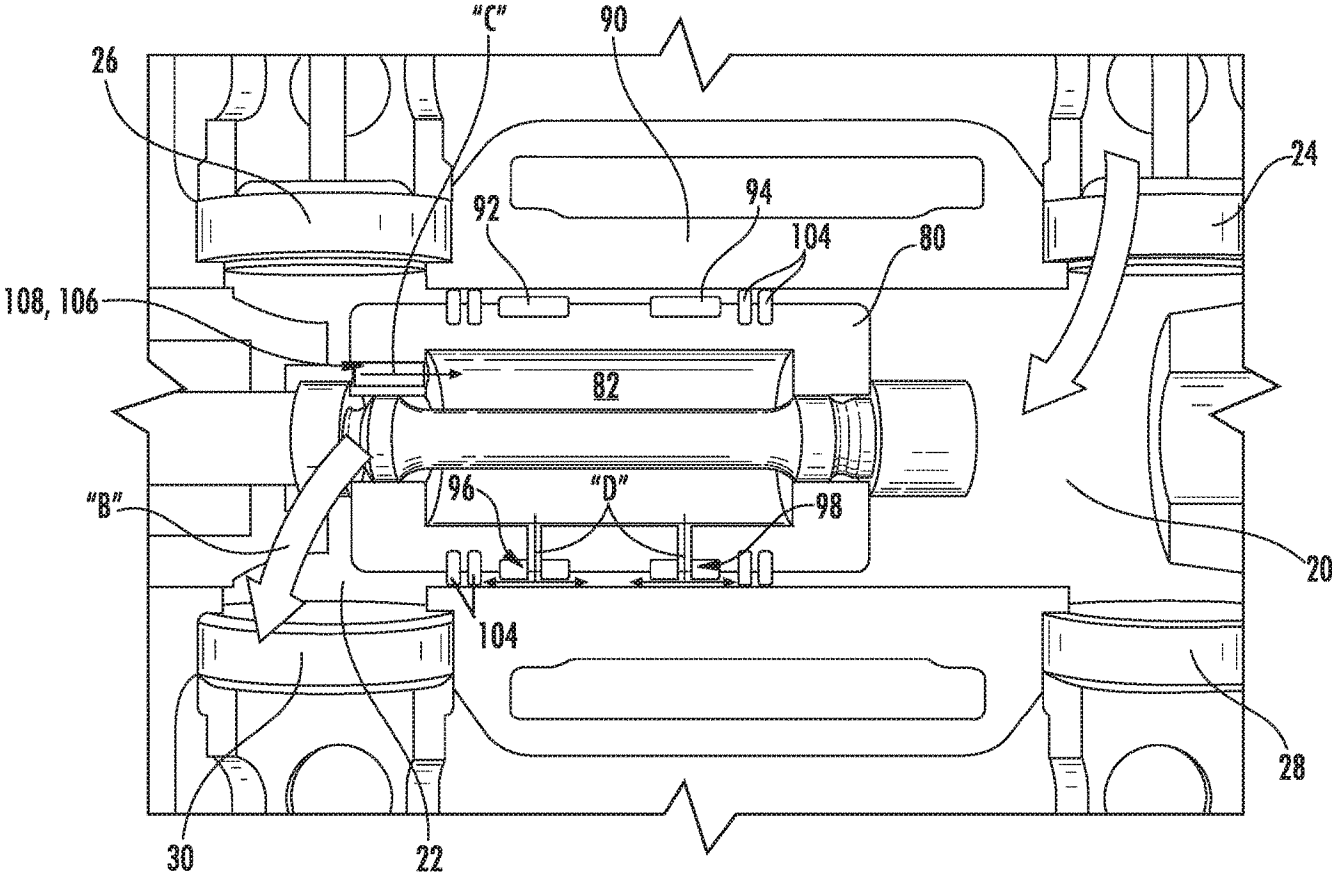
FIG. 7 is a cross section view of the exemplary FFP arrangement of FIG. 5 illustrating an exemplary flow of gas through the FFP.

FIG. 7 shows an exemplary gas flow path through the FFP orifice 108, valve 106 and piston 80 during operation. As can be seen, the piston 80 is positioned for reciprocal movement within the cylinder 90, so that as the piston 80 moves within the cylinder 90 gas is cyclically drawn in through inlet valves 24, 26 into compression chambers 20, 24 respectively, and is discharged through outlet valves 28, 30, respectively. In the illustrated position, the right-to-left movement of the piston 80 is drawing gas into compression chamber 20 via inlet valve 24. At the same time, gas that was previously drawn in via inlet valve 26 is being compressed in compression chamber 22 and is being discharged in the direction of arrow "B" through the outlet valve 28. As the gas in the compression chamber 22 reaches the cracking pressure of the valve 106 (i.e., a pressure that overcomes the biasing force of the valve spring 126), the facing surface 122 of the valve 106 moves away from the valve seat portion 124 allowing compressed gas to enter the inner chamber 82 of the piston 80 as shown by arrow "C." The compressed gas in the inner chamber 82 of the piston 80 then flows out through the outflow openings 96, 98 in the rider rings 92, 94 (i.e., along the direction of arrow "D") to create a thin gas layer between the piston 80 and cylinder 90. This thin gas layer provides a desired upward force on the piston 80, thereby countering the large downward force on the piston rings 104 and rider rings 92, 94 that would otherwise exist. Minimizing the downward force on the rider rings and piston rings thus reduces friction wear over the lifetime of the compressor.

Although FIG. 7 shows only the right-to-left stroke of the piston 80 has been described, it will be appreciated that a similar gas compression scheme will be effected by a left-to-right stroke (i.e., gas will be drawn into chamber 22 via inlet valve 26 and compressed gas will be expelled from chamber 20 via outlet valve 28). The difference, however, is that with the left-to-right stroke of the piston 80 gas is not admitted to the inner chamber 82 of the piston 80.

In some non-limiting embodiments the disclosed FFP arrangement can accommodate applications having a differential between suction and discharge pressures of the specific cylinder in excess of 50 bars (up to about 250 bars), and with piston diameters of 500 mm or less. It will be appreciated that other pressure differentials may also be accommodated using the disclosed design.

As described, the FFP valve 106 opens when the pressure in the compression chamber 22 exceeds the pressure in the inner chamber 82 of the piston 80. The pressure of the gas layer (i.e., the layer between the cylinder and the piston) is dictated by the weight of the piston and the profile of the outflow openings 96, 98 in the rider rings 92, 94. This gas layer can be referred to as the "gas bearing."

As will be appreciated, the differential pressure between the gas bearing and the inner chamber 82 decreases across the outflow openings 96, 98. The outflow openings limit the gas flow, and thus the gap (i.e., thickness) of the gas bearing. The outflow openings 96, 98 do not, however, influence the lifting force, so that when the pressure difference between the inner chamber and the gas bearing is high, the outflow openings cannot appropriately limit the gas flow, unless very narrow bores are used, which is undesirable. When the pressure ratio over the outflow openings 96, 98 approaches a critical ratio (<0.6) the bearing properties of the gas bearing can become unstable. This means that the gas bearing may not respond to variations in the load, the "stiffness" of the bearing is at or near zero, and the bearing will bounce.

Thus, as will be appreciated, the outflow openings in the rider rings 92, 94 determine the stiffness of the gas bearing. The optimum pressure ratio across the outflow openings 96, 98 is between about 0.6-0.8. In the case of a differential pressure in the specific cylinder, above 50 bars, this may not be sufficient to limit the gas flow to the gas bearing. In such a case, the pressure inside the piston inner chamber 82 must be reduced. The gas passage area of, for example, a 1" valve (valve 106) may be too large for the required flow, even with the minimum lift of the valve plate. The solution, as described, is to reduce the supply pressure to such a level that the pressure ratio over the outflow openings 96, 98 is within the desired (0.6-0.8) range. The supply pressure reduction can be obtained by the reduction of the flow passing through the FFP valve 106. To throttle the flow, an orifice 108 is fitted in the inlet of the valve 106. The bore of this orifice 108 can be adjusted to achieve a desired throttling area as appropriate for the application.

The orifice 108 functions to protect the valve for high differential pressures and therewith high impact velocities on the valve seat area 120. The operating conditions for the FFP valve 106 is quite different from those of "standard" compressor valves, as they are subjected to increasing differential pressures even when the valve is open, and to acceleration forces due to the motion of the piston 80.

The application of a throttling orifice upstream the valve plate is normally not done, since the orifice introduces flow losses, which is not desirable in traditional suction and discharge compressor valves. With the disclosed arrangement, the orifice/valve combination is capable of maintaining the gas pressure in the inner chamber 82 of the piston 80 at a desired level so that the differential pressure ratio across the outflow openings 96, 98 is maintained at between about 0.6 and about 0.8. It will be appreciated that this range is not limiting, and that the disclosed arrangement can be used with different differential pressure ratios.

This disclosed design is appropriate for, but is not limited to, use in high pressure compressor cylinders. It makes the application ranges more flexible. The invention can be applied to any size of valves or cylinder diameters Although disclosed in relation to double acting compressors, it will be clear that the arrangement described above for the bearing support of the piston/piston rod unit relative to the stationary portions of the compressor can also be used for single-acting or tandem compressors. While the present invention has been disclosed with reference to certain embodiments, numerous modifications, alterations and changes to the described embodiments are possible without departing from the spirit and scope of the invention, as defined in the appended claims. Accordingly, it is intended that the present invention not be limited to the described embodiments, but that it has the full scope defined by the language of the following claims, and equivalents thereof.

The invention claimed is:

1. A horizontal piston compressor for compressing a gas, comprising:

a frame having a cylinder oriented along a horizontal axis;

a piston reciprocably received in the cylinder, the piston having:

an inner chamber sized to store a volume of gas at a first pressure; and first and second end walls, that together with the cylinder, form at least one compression chamber in which the gas is compressed;

a valve and orifice disposed in at least a portion of the first end wall, the valve and orifice configured to admit gas from the at least one compression chamber to the inner chamber during a compression stroke of said piston, wherein the orifice extends through a body portion of the valve, the body portion has a plurality of flow paths through which gas can pass from the orifice to a valve seat area, and when a gas pressure in the at least one compression chamber rises above a cracking pressure of the valve, gas in the at least one compression chamber is admitted, through the orifice and the valve seat area of the valve, into the inner chamber of the piston, increasing a pressure of the volume of gas above the first pressure; and a gas bearing for supporting the piston relative to the frame, the gas bearing comprising an outflow opening for admitting gas from the inner chamber to a space between the piston and the cylinder when the pressure of the volume of gas rises above a predetermined pressure, the position of the at least one outflow opening and the pressure of the gas being such that the gas admitting to the space exerts an upward pressure on the piston rod unit while, together, the outflow opening and the valve and orifice maintain a pressure ratio between the inner chamber and the space between the piston and the cylinder.

2. The horizontal piston compressor of claim 1, wherein the valve comprises a spring-loaded valve, and the orifice comprises an orifice insert positioned between the valve and the at least one compression chamber.

3. The horizontal piston compressor of claim 2, wherein the valve has a 1-inch nominal diameter and the orifice insert has an orifice diameter between 2 millimeters (mm) to 5 mm and a throat length of 7 mm.

4. The horizontal piston compressor of claim 1, wherein together, the outflow opening and the valve and orifice are configured to maintain the pressure ratio between the inner chamber and the space between the piston and the cylinder, the pressure ratio being greater than 0.6.

5. The horizontal piston compressor of claim 1, wherein together, the outflow opening and the valve and orifice are configured to maintain the pressure ratio between the inner chamber and the space between the piston and the cylinder, the pressure ratio being between 0.6 and 0.8.

6. The horizontal piston compressor of claim 1, wherein the at least one compression chamber comprises first and second compression chambers, the first compression chamber formed by the cylinder and the first end wall of the piston, the second compression chamber formed by the cylinder and the second end wall of the piston, the first compression chamber having first inlet and outlet valves and the second compression chamber having second inlet and outlet valves.

7. The horizontal piston compressor of claim 1, wherein the outflow opening comprises a plurality of outflow openings, the horizontal piston compressor further comprising first and second rider rings disposed about a periphery of the piston, the first and second rider rings including the plurality of outflow openings.

8. The horizontal piston compressor of claim 7, wherein the plurality of outflow openings are disposed in a bottom portion of the first and second rider rings.

9. The horizontal piston compressor of claim 7, further comprising a plurality of piston rings disposed about the periphery of the piston, at least one of the plurality of piston rings disposed between the first rider ring and the first end wall of the piston and at least another of the plurality of piston rings disposed between the second rider ring and the second end wall of the piston.

10. A piston for use in a horizontal piston compressor, comprising:

a piston configured to be reciprocably received in a cylinder of said compressor, the piston having:

an inner chamber chamber sized to store a volume of gas at a first pressure; and first and second end walls that, together with the cylinder, form at least one compression chamber in which a gas is compressed;

a valve and orifice disposed in at least a portion of at least one of the first end wall and the second end wall, the valve and orifice configured to admit gas from the at least one compression chamber to the inner chamber during a compression stroke of said piston, wherein the orifice extends through a body portion of the valve, the body portion having a plurality of flow paths through which gas can pass from the orifice to a valve seat area; and wherein when a gas pressure in the at least one compression chamber rises above a cracking pressure of the valve, gas in the at least one compression chamber is admitted, through the orifice and the valve seat of area of the valve, into the inner chamber of the piston, increasing a pressure of the volume of gas above the first pressure; and a gas bearing for supporting the piston relative to a frame of the compressor, the gas bearing comprising an outflow opening for admitting gas from the inner chamber to a space between the piston and the cylinder when the pressure of the volume of gas rises above a predetermined pressure, the position of the at least one outflow opening and the pressure of the gas being such that the gas admitted to the space exerts an upward pressure on the piston while, together, the outflow opening and the valve and orifice maintain a pressure ratio between the inner chamber and the space between the piston and the cylinder.

11. The piston of claim 10, wherein the valve comprises a spring-loaded valve, and the orifice comprises an orifice insert positioned between the valve and the at least one compression chamber.

12. The piston of claim 11, wherein the valve has a 1-inch nominal diameter and the orifice insert has an orifice diameter between 2 mm and 5 mm and a throat length of 7 mm.

13. The piston of claim 10, wherein together, the outflow opening and the valve and orifice are configured to maintain the pressure ratio between the inner chamber and the space between the piston and the cylinder, the pressure ratio being greater than 0.6.

14. The piston of claim 10, wherein together, the outflow opening and the valve and orifice are configured to maintain the pressure ratio between the inner chamber and the space between the piston and the cylinder, the pressure ratio being between 0.6 and 0.8.

15. The piston of claim 10, wherein the outflow opening comprises a plurality of outflow openings, the piston further comprising first and second rider rings disposed about a periphery of the piston, the first and second rider rings including the plurality of outflow openings.

16. The piston of claim 15, further comprising a plurality of piston rings disposed about the periphery of the piston, at least one of the plurality of piston rings disposed between the first rider ring and the first end wall of the piston and at least another of the plurality of piston rings disposed between the second rider ring and the second end wall of the piston.

17. The piston of claim 10, wherein the plurality of outflow openings are disposed in a bottom portion of the first and second rider rings.

* * * * *